US011313630B2

(12) United States Patent
Maeyama

(10) Patent No.: US 11,313,630 B2
(45) Date of Patent: Apr. 26, 2022

(54) HEAT EXCHANGER AND REFRIGERATION CYCLE APPARATUS HAVING HEAT EXCHANGER

(71) Applicant: Mitsubishi Electric Corporation, Tokyo (JP)

(72) Inventor: Hideaki Maeyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 216 days.

(21) Appl. No.: 16/095,507

(22) PCT Filed: Jul. 1, 2016

(86) PCT No.: PCT/JP2016/069682

§ 371 (c)(1),
(2) Date: Oct. 22, 2018

(87) PCT Pub. No.: WO2018/003121

PCT Pub. Date: Jan. 4, 2018

(65) Prior Publication Data

US 2019/0128623 A1 May 2, 2019

(51) Int. Cl.

| | |
|---|---|
| ***F28F 1/32*** | (2006.01) |
| ***F25B 39/00*** | (2006.01) |
| ***F28D 1/053*** | (2006.01) |
| *F28D 21/00* | (2006.01) |
| *F28F 1/12* | (2006.01) |

(52) U.S. Cl.

CPC ..... *F28F 1/325* (2013.01); *F25B 39/00* (2013.01); *F28D 1/05383* (2013.01); *F28F 1/32* (2013.01); *F25B 2500/01* (2013.01); *F28D 2021/0068* (2013.01); *F28F 1/126* (2013.01); *F28F 2215/12* (2013.01)

(58) Field of Classification Search

CPC ..... F28F 1/325; F28F 1/38

See application file for complete search history.

(56) References Cited

U.S. PATENT DOCUMENTS 4,984,626 A * 1/1991 Esformes ..... F28F 1/325 165/151
5,501,270 A * 3/1996 Young ..... F28F 1/325 165/151

(Continued)

FOREIGN PATENT DOCUMENTS

CN 100465569 C 3/2009
EP 2 660 550 A1 11/2013

(Continued)

OTHER PUBLICATIONS

International Search Report of the International Searching Authority dated Sep. 20, 2016 for the corresponding International application No. PCT/JP2016/069682 (and English translation).

(Continued)

*Primary Examiner* — David J Teitelbaum
(74) *Attorney, Agent, or Firm* — Posz Law Group, PLC

(57) ABSTRACT

A heat exchanger includes plate-shaped fins and a plurality of heat transfer pipes attached to the fins so as to intersect the fins. The heat transfer pipes are disposed at intervals in a long-edge direction of the fins. The fins have a wave shape at at least a portion thereof and are capable of expanding and contracting in the long-edge direction.

8 Claims, 5 Drawing Sheets

(56) References Cited

U.S. PATENT DOCUMENTS

| | | | | |
|---|---|---|---|---|
| 5,582,244 | A * | 12/1996 | Helms | F28F 1/32 165/151 |
| 2008/0035321 | A1 | 2/2008 | Yoshioka et al. | |
| 2008/0115920 | A1 | 5/2008 | Uchida et al. | |
| 2008/0142201 | A1 | 6/2008 | Derosier et al. | |
| 2010/0252247 | A1* | 10/2010 | Smith, III | F28F 1/325 165/181 |
| 2015/0114613 | A1* | 4/2015 | Suzuki | B21D 53/085 165/182 |
| 2016/0320147 | A1* | 11/2016 | Wang | F28F 1/32 |

FOREIGN PATENT DOCUMENTS

| | | | |
|---|---|---|---|
| EP | 2 713 135 | A1 | 4/2014 |
| JP | S60-008695 | A | 1/1985 |
| JP | S61-198889 | U | 12/1986 |
| JP | S62-172971 | U | 11/1987 |
| JP | H05-099581 | A | 4/1993 |
| JP | 2001-194083 | A | 7/2001 |
| JP | 2006-017316 | A | 1/2006 |
| JP | 2008-128562 | A | 6/2008 |
| JP | 2011-002198 | A | 1/2011 |
| JP | 2011-127867 | A | 6/2011 |
| JP | 2011-202820 | A | 10/2011 |
| JP | 2013-217585 | A | 10/2013 |
| JP | 2015-132468 | A | 7/2015 |
| WO | 2016/067957 | A1 | 5/2016 |

OTHER PUBLICATIONS

Extended European Search Report dated May 20, 2019 issued in corresponding EP patent application No. 16907354.1.

Office Action dated Dec. 31, 2019 issued in corresponding CN patent application No. 201680086950.8 (and English translation).

* cited by examiner

HEAT EXCHANGER AND REFRIGERATION CYCLE APPARATUS HAVING HEAT EXCHANGER

CROSS REFERENCE TO RELATED APPLICATION

This application is a U.S. national stage application of International Application No. PCT/JP2016/069682, filed on Jul. 1, 2016, the contents of which are incorporated herein by reference.

TECHNICAL FIELD

The present invention relates to a heat exchanger having flat-shaped heat transfer pipes and to a refrigeration cycle apparatus having the heat exchanger.

BACKGROUND

In recent years, heat exchangers that use aluminum perforated flat pipes have been used in car air-conditioners, stationary air-conditioning apparatuses, and other air-conditioning apparatuses. The perforated flat pipes are heat transfer pipes whose horizontal width (long-axis direction in cross section) is larger than the vertical width (short-axis direction in cross section) and that have a plurality of fluid flow paths therein. Although corrugated fins are typically used in the heat exchangers using the perforated flat pipes, plate-type fins have come to be used these days. Hereinbelow, heat exchangers that use perforated flat pipes and plate-type fins will be referred to as fin-tube heat exchangers.

A typical fin-tube heat exchanger is configured such that heat transfer pipes, which are perforated flat pipes, are directly inserted into aluminum headers provided at the ends of the heat exchanger. Furthermore, plate fins have concavities having substantially the same shape as the cross-sectional shape of the perforated flat pipes. By inserting the perforated flat pipes into the concavities in the width direction of the fins, a fin-tube heat exchanger is produced. Typically, a method in which the heat transfer pipes, the fins, and the headers are simultaneously brazed together in a furnace is adopted.

A fin-tube heat exchanger in the related art has a configuration disclosed in, for example, Patent Literature 1. The fin-tube heat exchanger disclosed in Patent Literature 1 has a structure in which heat transfer pipes configured as perforated flat pipes are inserted, from side surfaces thereof, into tube insertion parts formed in fins and having the same shape as the heat transfer pipes, and their joint surfaces are brought into tight contact by a method such as brazing.

Patent Literature

Patent Literature 1: Japanese Unexamined Patent Application Publication No. 2015-132468

However, in general, when a fin-tube heat exchanger is produced, a large number of transfer pipes is required to be simultaneously inserted into the fins. Therefore, with the method disclosed in Patent Literature 1, when the fins and the heat transfer pipes are misaligned, an excessive force for inserting the large number of heat transfer pipes is generated, leading to potential insertion error, fin flexure, and other inconveniences.

Furthermore, to prevent misalignment between the heat transfer pipes and the fins, the clearance between the heat transfer pipes and the tube insertion parts provided in the fins may be increased. However, if the clearance between the tube insertion parts and the heat transfer pipes is increased, the brazing properties between the fins and the heat transfer pipes are deteriorated, causing problems such as poor adhesion and an increase in the amount of a brazing material used.

Furthermore, strict temperature control is also needed to prevent misalignment between the fins and the heat transfer pipes due to a thermal expansion difference. For example, aluminum has a coefficient of linear expansion of approximately $23\times10^{-6}$, and iron has a coefficient of linear expansion of approximately $12\times10^{-6}$. Therefore, for example, assuming that a heat exchanger having aluminum heat transfer pipes and fins has a height of 1 m in a stage direction, a tool for aligning the heat transfer pipes is made of iron, and the difference in temperature of a working space between summer and winter is 20 degrees C., the dimensional difference due to the difference in coefficient of linear expansion between aluminum and iron is as large as 0.26 mm for a length of 1 m, which is the height of the heat exchanger.

SUMMARY

The present invention has been made to overcome the above-described problems, and is aimed at providing: a heat exchanger in which the pitch of tube insertion parts formed in fins can be adjusted to the pitch of heat-transfer-pipe attaching portions in headers, into which the heat transfer pipes are inserted, and in which the easiness in assembly is improved; and a refrigeration cycle apparatus having this heat exchanger.

A heat exchanger of one embodiment of the present invention includes: plate-shaped fins; and a plurality of heat transfer pipes attached to the fins so as to intersect the fins. The heat transfer pipes are disposed at intervals in a long-edge direction of the fins, and the fins have a wave shape at at least a portion thereof and are capable of expanding and contracting in the long-edge direction.

A refrigeration cycle apparatus of another embodiment of the present invention includes a refrigerant circuit in which a compressor, a first heat exchanger, an expansion device, and a second heat exchanger are connected to one another by a refrigerant pipe. At least one of the first heat exchanger and the second heat exchanger is the aforementioned heat exchanger.

In the heat exchanger of one embodiment of the present invention, because the fins have a wave shape at at least a portion thereof and are capable of expanding and contracting in the longitudinal direction of the fins, it is possible to automatically adjust the pitch of the tube insertion parts in the fins. Therefore, the heat exchanger of one embodiment of the present invention improves the easiness in assembly of heat exchangers.

Furthermore, the refrigeration cycle apparatus of another embodiment of the present invention uses the aforementioned heat exchanger as at least one of the first heat exchanger and the second heat exchanger. As a result, the easiness in assembly is improved.

DETAILED DESCRIPTION

Figure 1:
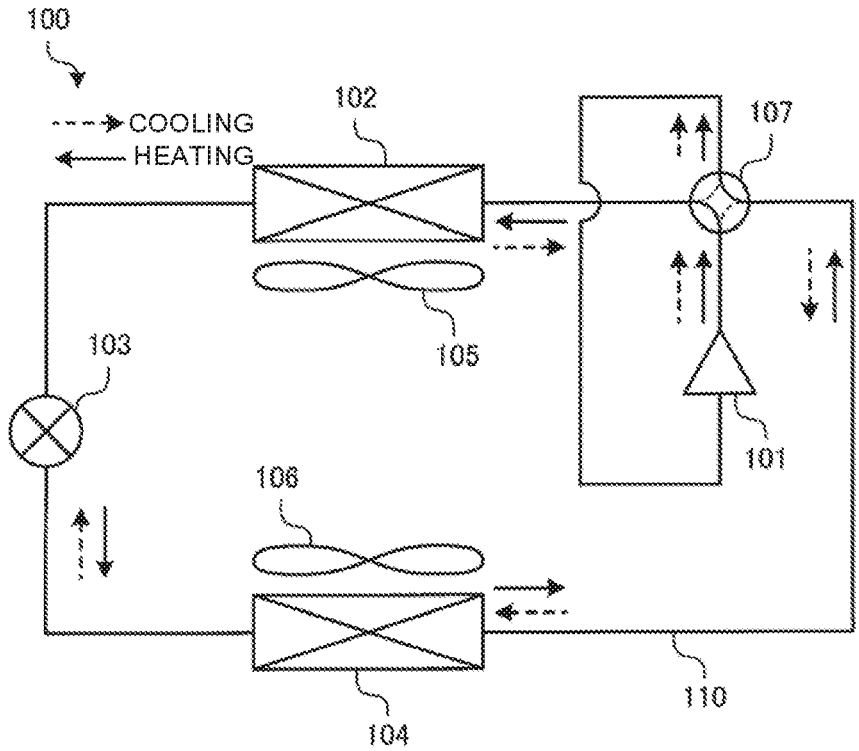
FIG. 1 is a schematic diagram showing an example of a configuration of a refrigerant circuit of an air-conditioning apparatus according to Embodiment 1 of the present invention.

Embodiments of the present invention will be described below with reference to the drawings as appropriate. Note that, in the drawings mentioned below, including FIG. 1, the size relationships among components may be different from the actual ones. Furthermore, in the drawings mentioned below, including FIG. 1, components denoted by the same reference signs are the same or corresponding components, and this is applied throughout the specification. Moreover, the configurations of the components described throughout the specification are merely examples, and the configurations of the components are not limited to those described.

Embodiment 1

First, an air-conditioning apparatus 100 according to Embodiment 1 of the present invention will be described. FIG. 1 is a schematic diagram showing an example of a configuration of a refrigerant circuit of the air-conditioning apparatus 100. Note that, in FIG. 1, the flow of refrigerant during a cooling operation is shown by dashed-line arrows, and the flow of the refrigerant during a heating operation is shown by solid-line arrows. Furthermore, the air-conditioning apparatus 100 is an example of a refrigeration cycle apparatus. Furthermore, the air-conditioning apparatus 100 includes a heat exchanger according to Embodiment 2 of the present invention, which will be described in detail below.

Configuration of Air-Conditioning Apparatus 100

As shown in FIG. 1, the air-conditioning apparatus 100 includes a compressor 101, a first heat exchanger 102, a first fan 105, an expansion device 103, a second heat exchanger 104, a second fan 106, and a flow-path switching device 107. The compressor 101, the first heat exchanger 102, the expansion device 103, the second heat exchanger 104, and the flow-path switching device 107 are connected to one another by a refrigerant pipe 110, forming a refrigerant circuit.

The compressor 101 compresses refrigerant. The refrigerant compressed in the compressor 101 is discharged and directed to the flow-path switching device 107. The compressor 101 may be, for example, a rotary compressor, a scroll compressor, a screw compressor, or a reciprocating compressor.

The first heat exchanger 102 serves as a condenser during the heating operation and serves as an evaporator during the cooling operation. The first heat exchanger 102 may be, for example, a fin-tube heat exchanger, a microchannel heat exchanger, a shell-and-tube heat exchanger, a heat-pipe heat exchanger, a double-pipe heat exchanger, or a plate heat exchanger. Note that, when the heat exchanger according to Embodiment 2 is used as the first heat exchanger 102, the first heat exchanger 102 is a fin-tube heat exchanger.

The expansion device 103 expands the refrigerant that has flowed through the first heat exchanger 102 or the second heat exchanger 104 to reduce the pressure thereof. The expansion device 103 may be, for example, an electronic expansion valve that can adjust the flow rate of the refrigerant. Note that, not only the electronic expansion valve, but also a mechanical expansion valve, which has a diaphragm serving as a pressure receiver, a capillary tube, or other valves may be used as the expansion device 103.

The second heat exchanger 104 serves as the evaporator during the heating operation and serves as the condenser during the cooling operation. The first heat exchanger 102 may be, for example, a fin-tube heat exchanger, a microchannel heat exchanger, a shell-and-tube heat exchanger, a heat-pipe heat exchanger, a double-pipe heat exchanger, or a plate heat exchanger. Note that, when the heat exchanger according to Embodiment 2 is used as the second heat exchanger 104, the second heat exchanger 104 is a fin-tube heat exchanger.

The flow-path switching device 107 switches between the flow of the refrigerant in the heating operation and the flow of the refrigerant in the cooling operation. That is, in the heating operation, the flow-path switching device 107 connects the compressor 101 and the first heat exchanger 102, and in the cooling operation, the flow-path switching device 107 connects the compressor and the second heat exchanger 104. Note that the flow-path switching device 107 may be, for example, four-way valve. Note that a combination of two-way valves or three-way valves may be used as the flow-path switching device 107.

The first fan 105 is provided on the first heat exchanger 102 and supplies air, serving as a heat exchange fluid, to the first heat exchanger 102.

The second fan 106 is attached to the second heat exchanger 104 and supplies air, serving as a heat exchange fluid, to the second heat exchanger 104.

Operation of Air-Conditioning Apparatus 100

Next, the operation of the air-conditioning apparatus 100, together with the flow of the refrigerant, will be described. Herein, the operation of the air-conditioning apparatus 100 will be described by taking as an example a case in which the heat exchange fluid is air, and the fluid that exchanges heat with the air is refrigerant. The operation of the air-conditioning apparatus 100 will be described based on an assumption that the first heat exchanger 102 cools or heats the air in an air-conditioned space. Note that the flow of the refrigerant during the cooling operation is shown by the dashed-line arrows in FIG. 1. Furthermore, the flow of the refrigerant during the heating operation is shown by the solid-line arrows in FIG. 1.

First, the cooling operation performed by the air-conditioning apparatus 100 will be described.

As shown in FIG. 1, by driving the compressor 101, high-temperature, high-pressure gaseous refrigerant is discharged from the compressor 101. Thereafter, the refrigerant flows along the dashed-line arrows. The high-temperature, high-pressure gas refrigerant (single phase) discharged from the compressor 101 flows through the flow-path switching device 107 into the second heat exchanger 104, serving as the condenser. In the second heat exchanger 104, the high-temperature, high-pressure gas refrigerant flowing therein exchanges heat with the air supplied by the second fan 106, and the high-temperature, high-pressure gas refrigerant condenses into high-pressure liquid refrigerant (single phase).

The high-pressure liquid refrigerant discharged from the second heat exchanger 104 is converted into two-phase refrigerant including low-pressure gas refrigerant and liquid refrigerant by the expansion device 103. The two-phase refrigerant flows into the first heat exchanger 102, serving as the evaporator. In the first heat exchanger 102, the two-phase refrigerant flowing therein exchanges heat with the air supplied by the first fan 105, evaporating the liquid refrigerant in the two-phase refrigerant and leaving low-pressure gas refrigerant (single phase). This heat exchange cools the air-conditioned space.

The low-pressure gas refrigerant discharged from the first heat exchanger 102 flows through the flow-path switching device 107 into the compressor 101, is compressed into high-temperature, high-pressure gas refrigerant, and is discharged from the compressor 101 again. Thereafter, this cycle is repeated.

Next, the heating operation performed by the air-conditioning apparatus 100 will be described.

As shown in FIG. 1, by driving the compressor 101, high-temperature, high-pressure gaseous refrigerant is discharged from the compressor 101. Thereafter, the refrigerant flows along the solid-line arrows. The high-temperature, high-pressure gas refrigerant (single phase) discharged from the compressor 101 flows through the flow-path switching device 107 into the first heat exchanger 102, serving as the condenser. In the first heat exchanger 102, the high-temperature, high-pressure gas refrigerant flowing therein exchanges heat with the air supplied by the first fan 105, and the high-temperature, high-pressure gas refrigerant condenses into high-pressure liquid refrigerant (single phase). This heat exchange heats the air-conditioned space.

The high-pressure liquid refrigerant discharged from the first heat exchanger 102 is converted into two-phase refrigerant including low-pressure gas refrigerant and liquid refrigerant by the expansion device 103. The two-phase refrigerant flows into the second heat exchanger 104, serving as the evaporator. In the second heat exchanger 104, the two-phase refrigerant flowing therein exchanges heat with the air supplied by the second fan 106, the liquid refrigerant in the two-phase refrigerant is evaporated to be low-pressure gas refrigerant (single phase).

The low-pressure gas refrigerant discharged from the second heat exchanger 104 flows through the flow-path switching device 107 into the compressor 101, is compressed into high-temperature, high-pressure gas refrigerant, and is discharged from the compressor 101 again. Thereafter, this cycle is repeated.

Embodiment 2

Figure 2:
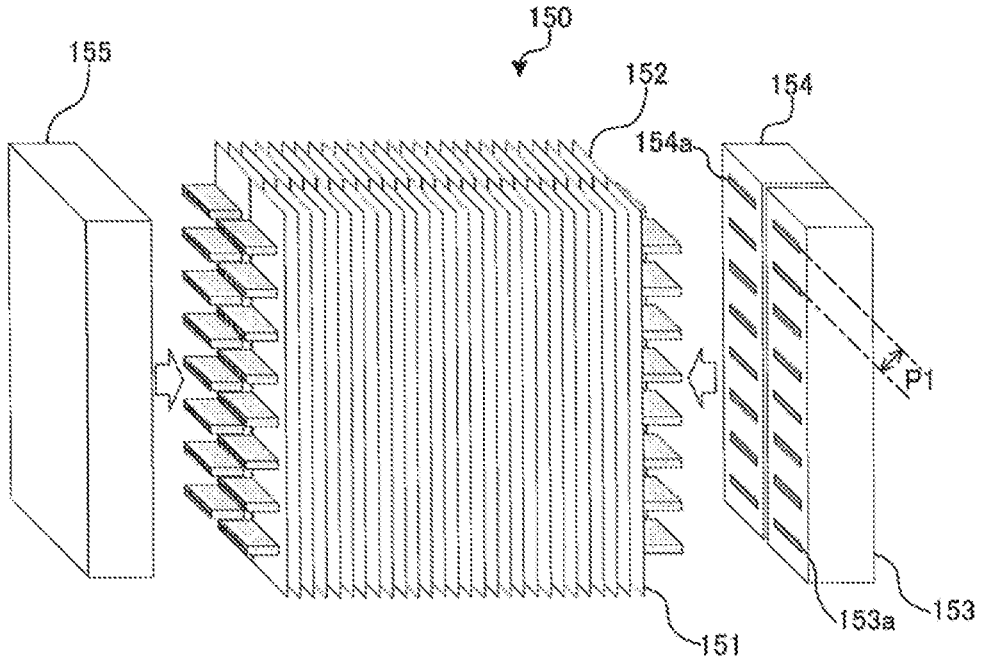
FIG. 2 is a schematic perspective view showing an example of an exterior configuration of a heat exchanger according to Embodiment 2 of the present invention.
Figure 3:
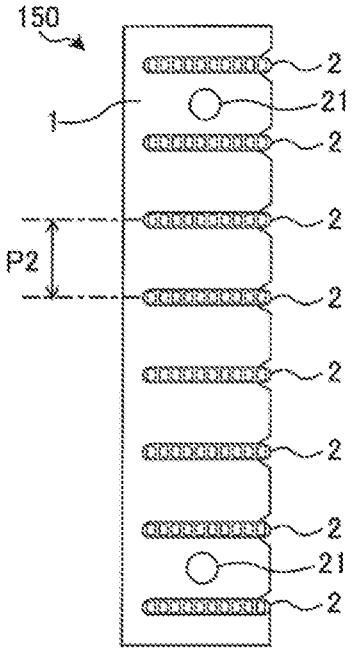
FIG. 3 is a side view showing an example of a configuration of the heat exchanger according to Embodiment 2 of the present invention.

FIG. 2 is a schematic perspective view showing an example of an exterior configuration of a heat exchanger (hereinbelow, referred to as a heat exchanger 150) according to Embodiment 2 of the present invention. FIG. 3 is a side view showing an example of a configuration of the heat exchanger 150. The heat exchanger 150 will be described with reference to FIGS. 2 and 3. Herein, a case in which the heat exchanger 150 is used as the second heat exchanger 104 of the air-conditioning apparatus 100 according to Embodiment 1 will be described as an example. However, the heat exchanger 150 may be used as the first heat exchanger 102 of the air-conditioning apparatus 100. That is, the heat exchanger 150 may be used as either of them.

As shown in FIG. 2, the heat exchanger 150 has a two-row structure and includes a windward heat exchanger 151, a leeward heat exchanger 152, a windward-header assembly pipe 153, a leeward-header assembly pipe 154, and a row-connecting part 155. Note that the windward heat exchanger 151 and the leeward heat exchanger 152 have the same configuration. It should be noted that, when the heat exchanger is explained below as the heat exchanger 150, it means both the windward heat exchanger 151 and the leeward heat exchanger 152.

Furthermore, as shown in FIG. 2, the windward-header assembly pipe 153 and the leeward-header assembly pipe 154 are attached to the windward heat exchanger 151 and the leeward heat exchanger 152, as shown by an empty arrow on the right side of the plane of the sheet. Moreover, as shown in FIG. 2, the row-connecting part 155 is attached to the windward heat exchanger 151 and the leeward heat exchanger 152, as shown by an empty arrow on the left side of the plane of the sheet. The heat exchanger 150 is produced in this way. Note that the windward heat exchanger 151 and the leeward heat exchanger 152 have the same configuration.

The windward-header assembly pipe 153 is provided with pipe-attaching parts 153*a*, which are openings, to which the heat transfer pipes 2 are attached. Similarly, the leeward-header assembly pipe 154 is provided with pipe-attaching parts 154*aa*, which are openings, to which the heat transfer pipes 2 are attached. The distance between the adjoining pipe-attaching parts 153*a* in the windward-header assembly pipe 153 is assumed to be a pitch P1. Similarly, the pipe-attaching parts 154*a* in the windward-header assembly pipe 153 are arranged side-by-side at the pitch P1.

As shown in FIGS. 2 and 3, the heat exchanger 150 includes a plurality of rectangular plate-shaped fins 1 having long edges and short edges, and a plurality of heat transfer pipes 2. Note that FIG. 3 shows, as an example, a case in which the number of the heat transfer pipes 2 is eight. As shown in FIG. 3, the distance between the adjoining tube insertion parts 5 in the fins 1 is assumed to be a pitch P2. Reference signs shown in FIGS. 1 to 3 will be used also in other drawings. Furthermore, in the description below, the direction parallel to the long edges of the fins 1 will be referred to as a longitudinal direction, and the direction parallel to the short edges of the fins 1 will be referred to as a transverse direction.

Schematic Configuration of Heat Transfer Pipe 2

Figure 4:
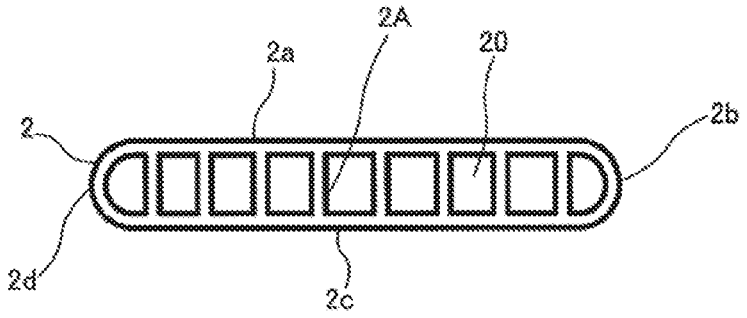
FIG. 4 is a schematic sectional view showing a section of a heat transfer pipe constituting the heat exchanger according to Embodiment 2 of the present invention.

FIG. 4 is a schematic sectional view showing a section of a heat transfer pipe constituting the heat exchanger 150. The heat transfer pipes 2 constituting the heat exchanger 150 will be described in detail with reference to FIG. 4.

The plurality of heat transfer pipes 2 are fitted into the plurality of tube insertion parts 5 provided in the fins 1. The heat transfer pipes 2 intersect the fins 1. As shown in FIG. 4, the heat transfer pipes 2 have such a shape that the horizontal width thereof (long-axis direction in cross section) is larger than the vertical width thereof (short-axis direction in cross section). That is, the long axis direction in cross section is equal to the direction in which the fluid flowing between the fins 1 circulates, and the plurality of heat transfer pipes 2 are arranged at intervals in the stage direction (top-bottom direction in the plane of the sheet), which is perpendicular to the circulation direction. Note that, in the description below, a portion extending along the long axis in cross section of the heat transfer pipes 2, that is, in the width direction (transverse direction) of the fins 1, will often be referred to as the width direction of the heat transfer pipes 2.

Although an explanation will be given taking as an example a case in which the heat transfer pipe 2 shown in FIG. 4 is a flat-shaped flat pipe, in which the horizontal width thereof (long-axis direction in cross section) is larger than the vertical width thereof (short-axis direction in cross section), the heat transfer pipe 2 is not required to be formed exactly in a flat shape, and the heat transfer pipe 2 is only required to have a shape in which the horizontal width thereof is larger than the vertical width thereof.

As shown in FIG. 4, the heat transfer pipe 2 includes a top surface 2*a* including an upper part, a bottom surface 2*c* including a lower part, a one side portion 2*b* including one end in the width direction (the end on the right side of the plane of the sheet in FIG. 4), and an other side portion 2*d* including the other end in the width direction (the end on the left side of the plane of the sheet in FIG. 4). Note that, although FIG. 4 shows an example of the heat transfer pipe 2 in which the top surface 2*a* and the bottom surface 2*c* are parallel to each other, the top surface 2*a* and the bottom surface 2*c* do not need to be parallel to each other (at least one of the top surface 2*a* and the bottom surface 2*c* may be inclined).

Each of the one side portion 2*b* and the other side portion 2*d* has an arc-shaped cross-sectional shape. In a state in which the heat transfer pipe 2 is fitted into the tube insertion part 5 in the fin 1, the other side portion 2*d* is located near a distal part 5*b* of the tube insertion part 5 formed in the fin 1, and the one side portion 2*b* is located near an open end 5*a* of the tube insertion part 5 formed in the fin 1.

The distance, in the gravity direction, between the heat transfer pipes 2 adjacent to each other in the top-bottom direction is equal to the pitch P2 of the adjoining tube insertion parts 5 in the fins 1 and is constant.

Furthermore, the heat transfer pipes 2 are made of, for example, aluminum or an aluminum alloy.

A plurality of partition walls 2A are formed inside each heat transfer pipe 2, and the partition walls 2A form a plurality of refrigerant flow paths 20 inside the heat transfer pipe 2. Note that grooves or slits may be provided in the surfaces of the partition walls 2A and the inner wall surfaces of the heat transfer pipe 2. By doing so, the contact area with the refrigerant flowing through the refrigerant flow paths 20 increases, and the heat exchange efficiency is improved.

The heat transfer pipe 2 is formed such that the top surface 2*a* and the bottom surface 2*c* are substantially symmetrical with respect to the horizontal line extending through the central part in the width direction. This makes it easy to ensure the manufacturing efficiency when the heat transfer pipes 2 are formed by extrusion molding.

Note that the heat transfer pipes 2 may be formed to have an elliptical cross section by, for example, extrusion molding, and then, additional machining may be performed to form the final shape.

Detailed Configuration 1 of Fin 1

Figure 5:
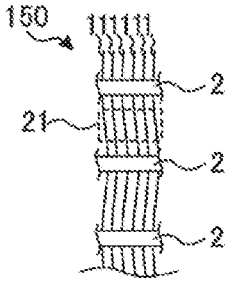
FIG. 5 is a side view showing an example of a configuration of the heat exchanger according to Embodiment 2 of the present invention, as viewed from another direction.
Figure 6:
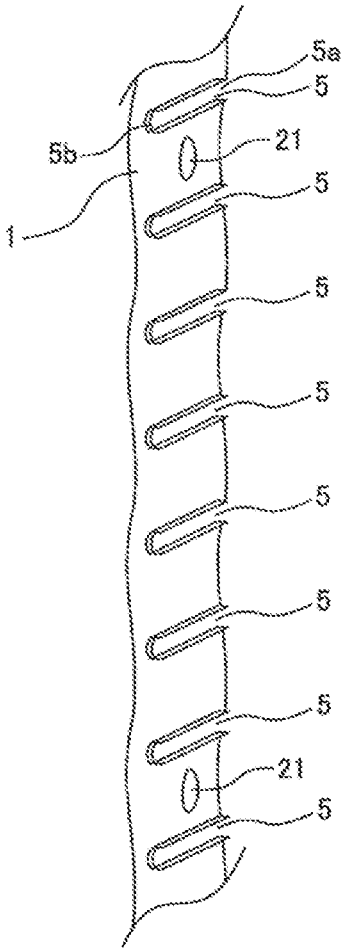
FIG. 6 is shows an example of a specific configuration of a fin constituting the heat exchanger according to Embodiment 2 of the present invention.

FIG. 5 is a side view showing an example of a configuration of the heat exchanger 150, as viewed from another direction. FIG. 6 shows an example of a specific configuration of the fin 1 constituting the heat exchanger 150. An example of a specific configuration of the fin 1 will be described in detail with reference to FIGS. 5 and 6. FIG. 5 schematically shows a portion in which the number of the fins 1 is six, and the number of the heat transfer pipes 2 is three. Furthermore, FIG. 6 shows a portion in which eight tube insertion parts 5 are formed.

Note that the top-bottom direction in the plane of the sheet of FIG. 6 is referred to as the longitudinal direction of the fins 1, and the direction in which the heat transfer pipes 2 insert the fins 1 is referred to as the transverse direction of the fins 1. Note that the transverse direction of the fins 1 may also be referred to as the width direction of the fins 1. These definitions will also be used in the same way in the following description.

As shown in FIGS. 5 and 6, the fins 1 are plate-shaped components having a longitudinal direction and a transverse direction. The fins 1 each have a plurality of tube insertion parts 5 arranged at intervals in the longitudinal direction. The tube insertion parts 5 are formed as openings such that they extend in the transverse direction of the fin 1 and such that portions thereof on one edge of the fin 1 are open. In FIG. 6, one end of each tube insertion part 5 is illustrated as the open end part 5*a*, and the other side of each tube insertion part 5 is illustrated as the distal part 5*b*. Furthermore, as shown in FIG. 6, each fin 1 has two positioning holes 21 at two vertical positions. Note that the fins 1 are formed of, for example, aluminum or an aluminum alloy.

The distal parts 5*b* of the tube insertion parts 5 have a semicircular shape. The shape of the distal parts 5*b* is not limited to a semicircular shape, and the distal parts 5*b* may have an elliptical shape. In other words, it is desirable that the distal parts 5*b* have a shape conforming to the shape of the other side portions 2*d* of the heat transfer pipes 2 inserted into the tube insertion parts 5.

Furthermore, the fins 1 are configured to have a wave shape having crests and troughs. The wave shape is formed in the longitudinal direction of the plate-shaped components constituting the fins 1. In other words, the fins 1 are configured to have a wave shape in which the crests and troughs extend in the transverse direction of the fins 1. More specifically, the fins 1 are configured such that the ridges of the crests of the wave shape extend in the width of the fins 1. Because the fins 1 have a wave shape in a portion thereof, the fins 1 can expand and contract in the longitudinal direction thereof.

Moreover, the tube insertion parts 5 are formed at the crests and troughs of the wave shape of the fins 1. In other words, the heat transfer pipes 2 are fitted at the crests and troughs of the wave shape of the fins 1. Furthermore, it is desirable that the pitch of the wave shape of the fins 1 be about twice the pitch P2. Note that the pitch of the wave shape of the fins 1 is the distance between a crest and a crest (or a trough and a trough) constituting the wave shape.

Note that the number of the waves is not specifically limited, and the waves may be formed according to the number of the heat transfer pipes 2 fitted. Furthermore, the shape of the peaks of the crests and troughs of the wave shape is not specifically limited, and the peaks may be either angled or rounded as R portions. Moreover, the angle of the peaks of the crests and troughs of the wave shape is not specifically limited. Moreover, the ridges of the crests in the wave shape do not necessarily have to be exactly parallel to the transverse direction of the fins 1.

Process of Producing Heat Exchanger 150

Now, a process of producing the heat exchanger 150 will be described.

First, the fins 1 having the tube insertion parts 5 in which the heat transfer pipes 2 can be inserted from one edge side are prepared. The heat transfer pipes 2 to be fitted in the tube insertion parts 5 in the fins 1 are prepared. Then, the heat transfer pipes 2 are inserted into the tube insertion parts 5 in the fins 1. Once the heat transfer pipes 2 are inserted into the tube insertion parts 5, the heat transfer pipes 2 and the fins 1 are fixed together. For example, the heat transfer pipes 2 and the fins 1 can be fixed together by brazing, bonding, or other methods.

The both ends of the heat transfer pipes 2 are directly inserted into the headers (for example, the windward-header assembly pipe 153 and the leeward-header assembly pipe 154 as shown in FIG. 2) and the connecting part (for example, the row-connecting part 155 as shown in FIG. 2) (see the empty arrows shown in FIG. 2). The ends of the heat transfer pipes 2 inserted into these parts are fixed by, for example, brazing or other methods.

As described, the heat exchanger 150 is assembled by a production process in which the fins 1 and then the headers are attached to the heat transfer pipes 2. In other words, because the pitch of the vertically adjoining heat transfer pipes 2 is restricted by the pitch P2 of the tube insertion parts 5 in the fins 1, which are attached first, the heat transfer pipes 2 may be misaligned with heat-transfer-pipe attaching portions formed in the headers due to the position tolerance of the heat-transfer-pipe attaching portions (for example, the pipe-attaching parts 153*a* and the pipe-attaching parts 154*a* shown in FIG. 2) formed in the headers, the difference in temperature between the work pieces during assembly, or other reasons.

Hence, the fins 1 configured to have a wave shape are used in the heat exchanger 150. The fins 1 configured to have a wave shape are more flexible and more easily expand and contract than fins formed of flat plate-shaped components. Therefore, the pitch P2 of the tube insertion parts 5 in the fins 1 can be adjusted so as to be equal to the pitch P1 of the heat-transfer-pipe attaching portions in the headers. In other words, the pitch P2 of the tube insertion parts 5 in the fins 1 can be made equal to the pitch P1 of the heat-transfer-pipe attaching portions in the headers, as a result of the fins 1 expanding and contracting in the longitudinal direction.

Accordingly, when the heat transfer pipes 2 to which the fins 1 are attached are inserted into the headers, the pitch P2 of the tube insertion parts 5 in the fins 1 can be adjusted in accordance with the pitch P1 of the heat-transfer-pipe attaching portions in the headers. Therefore, it is possible to automatically correct, with the fins 1, the difference between the pitch P1 and the pitch P2, thus improving the easiness in assembly of the heat exchanger 150.

Furthermore, because the heat transfer pipes 2 are attached at the crests and troughs of the wave shape of the fins 1, even when the fins 1 are deformed to change the pitch P2 of the tube insertion parts 5, the tube insertion parts 5 in the fins 1 are maintained to be perpendicular to the heat transfer pipes 2. Therefore, it is possible to minimize inclination (bending) of the fins 1 with respect to the heat transfer pipes 2 and erroneous insertion of the heat transfer pipes due to inclination of the fins 1.

Note that the same advantage can be obtained also in a method in which the heat transfer pipes 2 are attached to the header first, and then the heat transfer pipes 2 are inserted into the fins 1.

Furthermore, although a case where the fins 1 have a wave shape overall in the longitudinal direction thereof was described, the shape is not limited thereto, and at least a portion of the fins 1 needs to have a wave shape. The area of the portion having a wave shape may be determined taking into consideration the magnitude of the potential difference between the pitch P1 and the pitch P2.

Furthermore, there is no need for all the fins 1 to have a wave shape, and at least one of the fins 1 is required to have a wave shape. However, it is preferable that all the fins 1 or one in every several fins 1 have a wave shape. The same applies to the fins 1 having other configurations described below.

Detailed Configuration 2 of Fin 1

Figure 7:
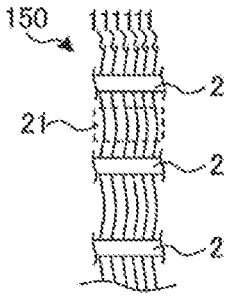
FIG. 7 is a side view showing another example of a configuration of the heat exchanger according to Embodiment 2 of the present invention, as viewed in another direction.
Figure 8:
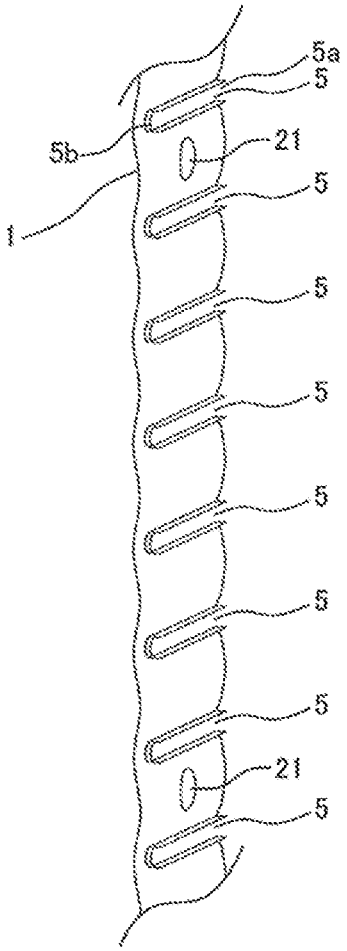
FIG. 8 shows another example of a specific configuration of the fin constituting the heat exchanger according to Embodiment 2 of the present invention.

FIG. 7 is a side view showing another example of a configuration of the heat exchanger 150, as viewed from another direction. FIG. 8 shows another example of a specific configuration of the fin 1 constituting the heat exchanger 150. One of the examples of a specific configuration of the fins 1 will be described in detail with reference to FIGS. 7 and 8. FIG. 7 schematically shows a portion in which the number of the fins 1 is six, and the number of the heat transfer pipes 2 is three. Furthermore, FIG. 8 shows a portion in which eight tube insertion parts 5 are formed.

Whereas FIGS. 5 and 6 show, as an example, a case where the tube insertion parts 5 are formed at the crests and troughs of the wave shape of the fins 1, FIGS. 7 and 8 show, as an example, a case where the tube insertion parts 5 are formed at either the crests or troughs of the wave shape of the fins 1. The other configurations are basically the same as those described with reference to FIGS. 5 and 6. That is, the pitch of the wave shape of the fins 1 is equal to the pitch P2.

Also this configuration allows the fins 1 to expand and contract in the longitudinal direction, thus making it possible to automatically correct, with the fins 1, the difference between the pitch P1 and the pitch P2. Therefore, it is possible to improve the easiness in assembly of the heat exchanger 150 and to minimize inclination (bending) of the fins 1 with respect to the heat transfer pipes 2 and erroneous insertion of the heat transfer pipes due to inclination of the fins 1.

Furthermore, in the fins 1 having the tube insertion parts 5 formed at either the crests or troughs of the wave shape, when the fins 1 are deformed, and the pitch P2 of the tube insertion parts 5 is changed, the wave shape between the vertically adjoining tube insertion parts 5 in the fins 1 moves in the fin pitch direction. Therefore, the portions at which the heat transfer pipes 2 and the fins 1 are attached together do not move in the fin pitch direction, and thus, the fin pitch is stabilized. Note that the fin pitch is the distance between the fins 1.

Detailed Configuration 3 of Fin 1

Figure 9:
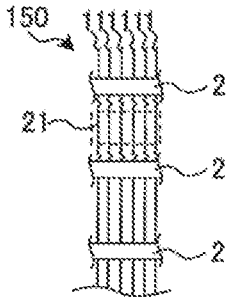
FIG. 9 is a side view showing another example of a configuration of the heat exchanger according to Embodiment 2 of the present invention, as viewed from another direction.
Figure 10:
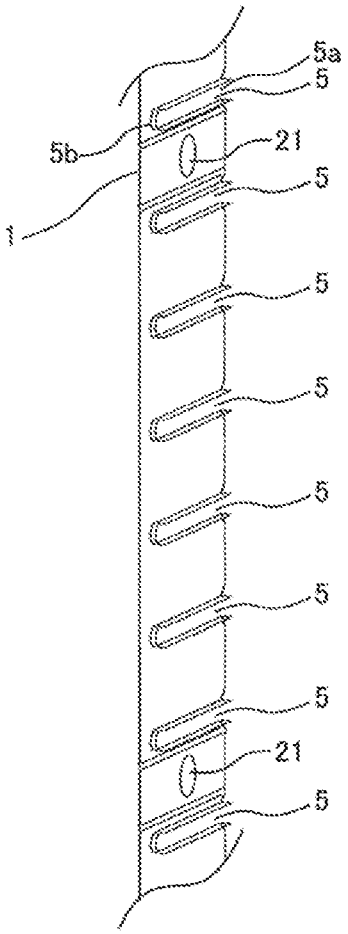
FIG. 10 shows another example of a specific configuration of the fin constituting the heat exchanger according to Embodiment 2 of the present invention.

FIG. 9 is a side view showing another example of a configuration of the heat exchanger 150, as viewed from another direction. FIG. 10 shows another example of a specific configuration of the fin 1 constituting the heat exchanger 150. One of the examples of a specific configuration of the fins 1 will be described in detail with reference to FIGS. 9 and 10. FIG. 9 schematically shows a portion in which the number of the fins 1 is six, and the number of the heat transfer pipes 2 is three. Furthermore, FIG. 10 shows a portion in which eight tube insertion parts 5 are formed.

Whereas FIGS. 5 to 8 show a case where the fins 1 have a wave shape overall in the longitudinal direction thereof, FIGS. 9 and 10 show, as an example, a case where the wave shape is formed at a portion of the fins 1. More specifically, the wave shape having a pitch smaller than the pitch P2 of the tube insertion parts 5 is formed at a portion of the fins 1. Furthermore, FIGS. 9 and 10 show, as an example, in which the wave shape is formed between the positioning holes 21 and the tube insertion parts 5 adjacent to the positioning holes 21. The other configurations are basically the same as those described with reference to FIGS. 5 to 8.

Also this configuration allows the fins 1 to expand and contract in the longitudinal direction, thus making it possible to automatically correct, with the fins 1, the difference between the pitch P1 and the pitch P2. Therefore, it is possible to improve the easiness in assembly of the heat exchanger 150 and to minimize inclination (bending) of the fins 1 with respect to the heat transfer pipes 2 and erroneous insertion of the heat transfer pipes due to inclination of the fins 1.

Typically, a pattern, such as scratches or slits, is often formed in the fins 1. In that case, forming surfaces of the fins 1 are desirably flat for the shape stability. Hence, in FIGS. 9 and 10, the wave shape is formed at a portion of the fins 1. Therefore, the fins 1 are locally deformed at the wave shape, allowing the portions other than the wave shape to be maintained flat. Accordingly, it is possible to stably form a pattern, such as scratches or slits. Note that, although FIGS. 9 and 10 show an example in which the wave shape is formed between the positioning holes 21 and the tube insertion parts 5 adjacent to the positioning holes 21, the position where the wave shape is formed is not limited to these positions.

Attachment of Heat Transfer Pipe 2 to Fin 1

In the heat exchanger 150, the heat transfer pipes 2 and the fins 1 are joined together by means of interference fitting.

Typical fins do not have a function of automatically correcting the pitch difference. Therefore, if the clearance between the heat transfer pipes and the tube insertion parts in the fins are reduced in size, portions of the fins interfering with the heat transfer pipes are deformed, making attachment of the heat transfer pipes difficult. Accordingly, in the related-art heat exchangers, the size of the clearance between the heat transfer pipes and the tube insertion parts in the fins cannot be reduced, and hence, interference fitting is not used to attach the heat transfer pipes to the fins.

Meanwhile, because the heat exchanger 150 has the fins 1 having a shape as shown in FIGS. 5 to 10, the pitch difference is automatically adjusted, and thus, the clearance between the heat transfer pipes and the tube insertion parts can be minimized. In other words, because the heat exchanger 150 does not overcome the pitch difference by means of the clearance between the heat transfer pipes 2 and the tube insertion parts 5 in the fins 1, the heat transfer pipes 2 can be attached to the fins 1 by means of interference fitting, in which the clearance therebetween are small. By attaching the heat transfer pipes 2 to the fins 1 by means of interference fitting, it is possible to improve the brazing properties and the adhesion, while reducing the amount of brass used.

As has been described above, in the heat exchanger 150, the fins 1 have a shape capable of automatically adjusting the pitch difference. Hence, it is possible to adjust the pitch P2 of the tube insertion parts 5 in the fins 1 in accordance with the pitch P1 of the heat-transfer-pipe attaching portions in the headers. Therefore, in the heat exchanger 150, there is no difference between the pitch P2 of the tube insertion parts 5 in the fins 1 and the pitch P1 of the heat-transfer-pipe attaching portions in the headers, thus improving the easiness in assembly.

Furthermore, because the air-conditioning apparatus 100 according to Embodiment 1 uses at least one of the first heat exchanger 102 and the second heat exchanger 104 as the heat exchanger 150, the easiness in assembly is improved.

Although detailed configurations of the heat exchanger of the present invention have been described above, the configuration of the heat exchanger is not limited thereto and can be variously modified or changed without departing from the scope and the spirit of the present invention. Furthermore, although a heat exchanger having a plurality of fins 1 has been described as an example, the configuration is not limited thereto, and the number of the fins 1 may be one.

The invention claimed is:

1. A heat exchanger comprising:

plate-shaped fins, wherein each fin has a short-edge direction, which is parallel to a short edge of the fins, and a long-edge direction, which is parallel to a long edge of the fins, and the short edge direction is perpendicular to the long-edge direction;

a plurality of heat transfer pipes attached to tube insertion parts formed in the fins to intersect the fins, and headers having heat transfer-pipe-attaching portions, wherein ends of the heat transfer pipes are inserted into the heat transfer-pipe-attaching portions, wherein the heat transfer pipes are disposed at intervals in the long-edge direction of the fins, and at least a portion of the fins have a wave shape, and each of crests and troughs in the wave shape extend in the short-edge direction of the fins, and ridges of the crests extend in the short-edge direction of the fins, which allows the fins to expand and contract in the long-edge direction such that a pitch of the tube insertion parts of the fins is adjusted to a pitch of the pipe-attaching parts in the headers.

2. The heat exchanger of claim 1, wherein a pitch of the wave shape is twice a pitch of the tube insertion parts formed in the fins.

3. The heat exchanger of claim 2, wherein the tube insertion parts are formed at peak portions of the wave shape.

4. The heat exchanger of claim 1, wherein a pitch of the wave shape is equal to a pitch of the tube insertion parts formed in the fins.

5. The heat exchanger of claim 1, wherein a pitch of the wave shape is smaller than a pitch of the tube insertion parts formed in the fins.

6. The heat exchanger of claim 5, wherein the wave shape is formed between a positioning hole formed in the fins and a tube insertion part adjacent to the positioning hole.

7. The heat exchanger of claim 1, wherein the heat transfer pipes are interference fitted to the fins.

8. A refrigeration cycle apparatus comprising a refrigerant circuit in which a compressor, a first heat exchanger, an expansion device, and a second heat exchanger are connected to one another by a refrigerant pipe, wherein at least one of the first heat exchanger and the second heat exchanger is the heat exchanger of claim 1.

* * * * *